US007988463B2

(12) United States Patent
Zhu

(10) Patent No.: US 7,988,463 B2
(45) Date of Patent: Aug. 2, 2011

(54) ELECTRICAL CONNECTOR RETAINING A PRINT CIRCUIT BOARD AT A MIDDLE HIGHNESS

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/850,050

(22) Filed: Aug. 4, 2010

(65) Prior Publication Data

US 2011/0034046 A1 Feb. 10, 2011

(30) Foreign Application Priority Data

Aug. 4, 2009 (CN) ..... 2009 2 0307323
Aug. 4, 2009 (CN) ..... 2009 2 0307328

(51) Int. Cl.
*H01R 12/00* (2006.01)

(52) U.S. Cl. ..... 439/83

(58) Field of Classification Search ..... 439/63, 439/83, 660, 492, 636, 876, 547, 79
See application file for complete search history.

(56) References Cited

U.S. PATENT DOCUMENTS 5,316,489 A * 5/1994 Kachlic et al. ..... 439/79
5,573,408 A * 11/1996 Laub et al. ..... 439/62
2002/0132517 A1* 9/2002 Tharp et al. ..... 439/492
2002/0132530 A1* 9/2002 Tharp et al. ..... 439/660
2002/0177332 A1* 11/2002 Hubbard et al. ..... 439/63

* cited by examiner

*Primary Examiner* — Jean F Duverne
(74) *Attorney, Agent, or Firm* — Wei Te Chung; Andrew C. Cheng; Ming Chieh Chang

(57) ABSTRACT

An electrical connector secured to a PCB having a plurality of welding areas on an upward face and a plurality of through holes running through the PCB includes an elongate insulative housing and a plurality of contacts assembled to the insulative housing. The insulative housing defines a mating face and a mounting face opposite to the mating face, a plurality of blocks protruding from the mounting face. Each contact defines a contacting portion connecting with a mating connector, a retaining portion retained in the insulative housing and a soldering portion welding to the welding areas of the PCB. A plurality of board-lock pieces made of metal material are under the corresponding blocks to clip the PCB between the blocks and the board-lock pieces. A projection from one of the board-lock piece and the block is inserted into the through hole.

3 Claims, 11 Drawing Sheets

ELECTRICAL CONNECTOR RETAINING A PRINT CIRCUIT BOARD AT A MIDDLE HIGHNESS

BACKGROUND OF THE INVENTION

1. Field of the Invention

The present invention relates to an electrical connector, and more particularly to an electrical connector having a board-lock structure to retain a print circuit board at a middle highness of the electrical connector.

2. Description of the Related Art

A traditional electrical connector comprises an insulative housing and a plurality of contacts received in the insulative housing. Each contact includes a contacting portion mating with a mating connector, a retaining portion by which the electrical connector is retained in the insulative housing and a soldering portion welded to a PCB (Print Circuit Board). The electrical connector is secured to the PCB just by the soldering portion so that the electrical connector might release from the PCB.

In view of the above, a new electrical connector that overcomes the above-mentioned disadvantages is desired.

SUMMARY OF THE INVENTION

Accordingly, an object of the present invention is to provide an electrical connector having a board-lock structure to retain a PCB at a middle highness of the electrical connector.

To fulfill the above-mentioned object, an electrical connector secured to a PCB having a plurality of welding areas on an upward face and a plurality of through holes running through the PCB comprises an elongate insulative housing and a plurality of contacts assembled to the insulative housing. The insulative housing defines a mating face and a mounting face opposite to the mating face, a plurality of blocks protruding from the mounting face. Each contact defines a contacting portion connecting with a mating connector, a retaining portion retained in the insulative housing and a soldering portion welding to the welding areas of the PCB. A plurality of board-lock pieces made of metal material are under the corresponding blocks to clip the PCB between the blocks and the board-lock pieces. A projection from one of the board-lock piece and the block is inserted into the through hole.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
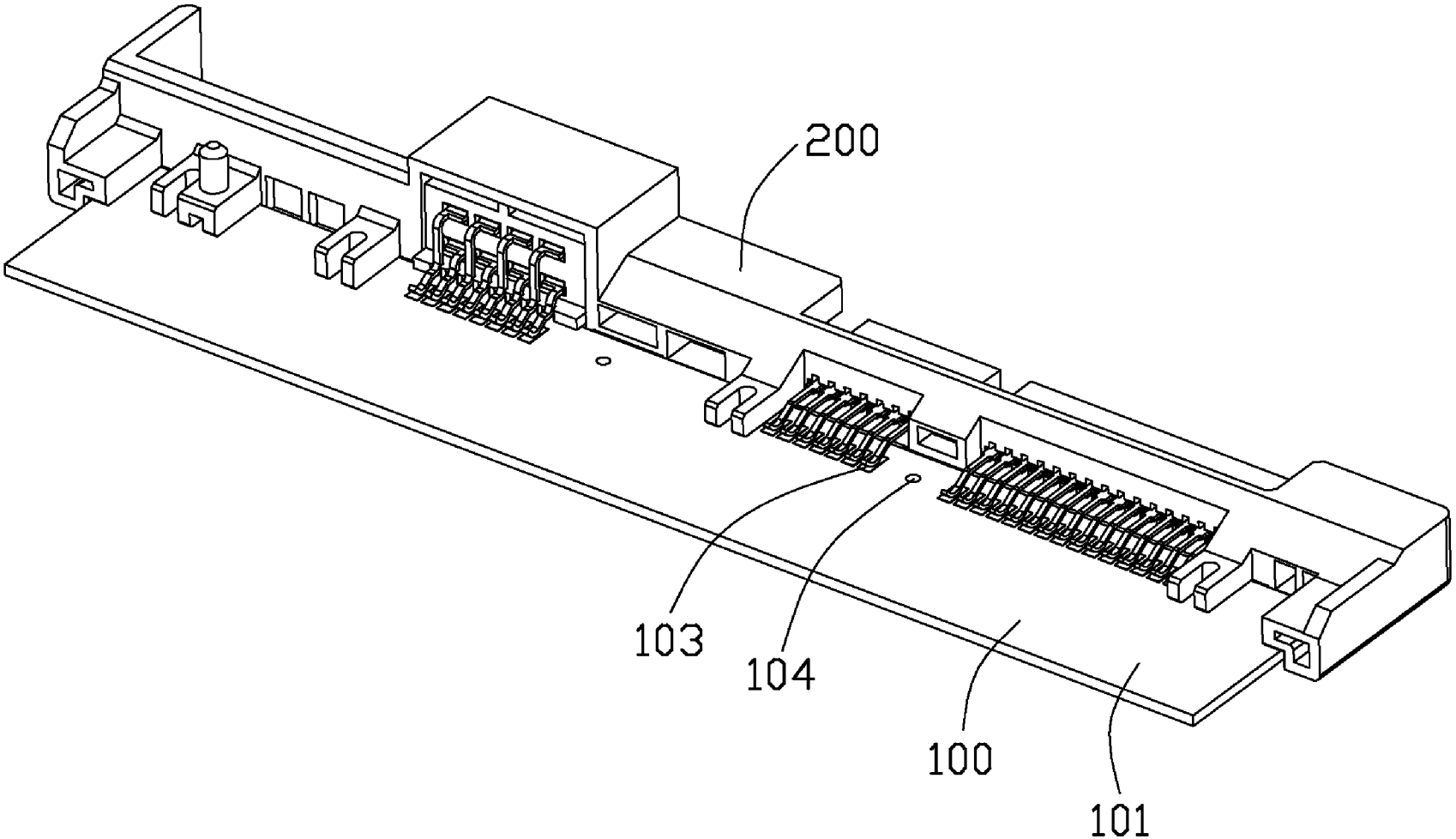
FIG. 1 is a top and rear perspective view of an electrical connector in accordance with a first embodiment of the present invention secured to a PCB.
Figure 2:
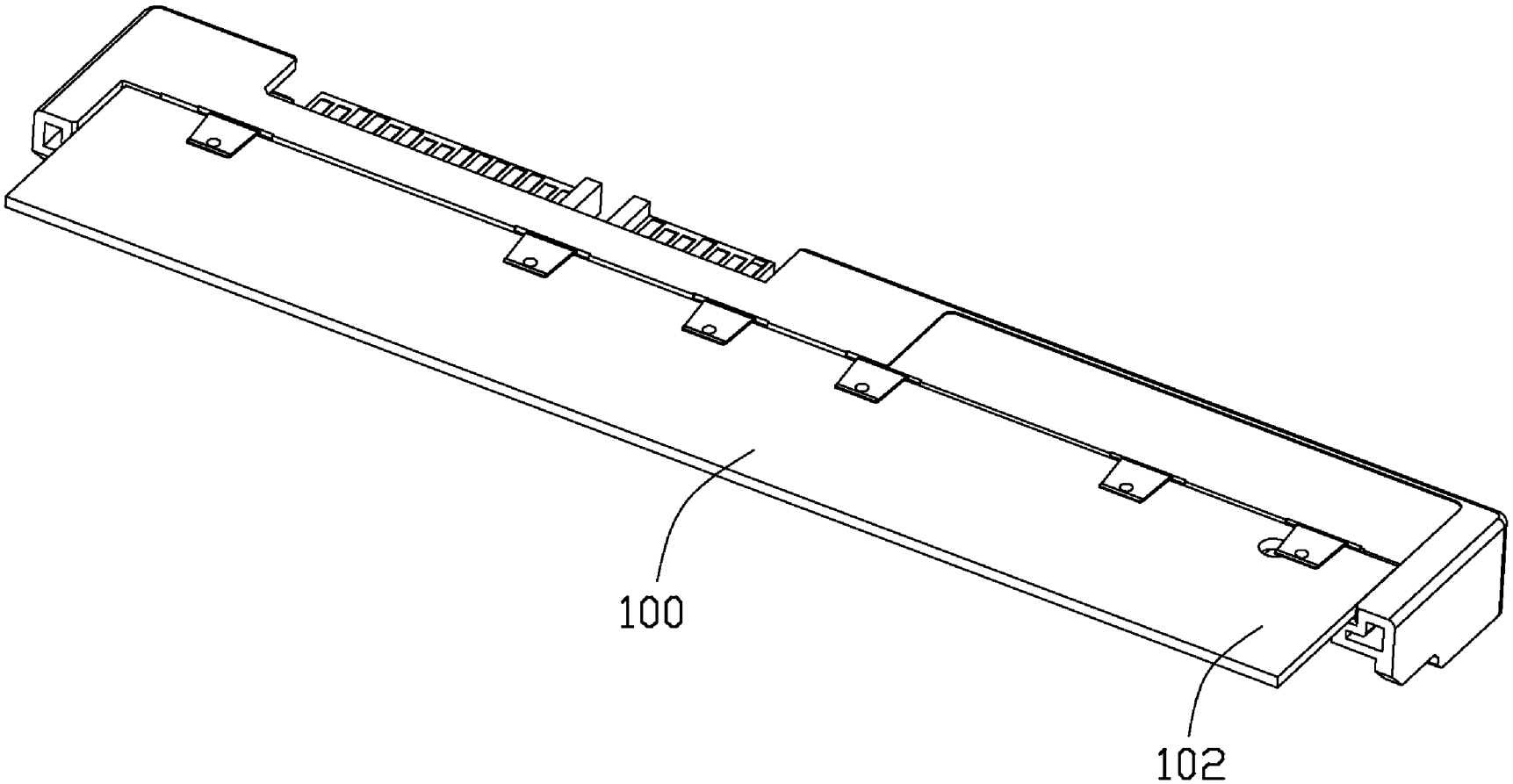
FIG. 2 is a bottom and rear perspective view of the electrical connector of FIG. 1 secured to the PCB.

Referring to FIGS. 1-2, an electrical connector 200 is secured to a PCB 100. The PCB 100 defines an upward face 101 and a downward face 102 opposite to the upward face 101. A plurality of welding areas 103 such as conductive pads form on the upward face 101 and a plurality of through holes 104 run through the upward face 101 and the downward face 102.

Figure 3:
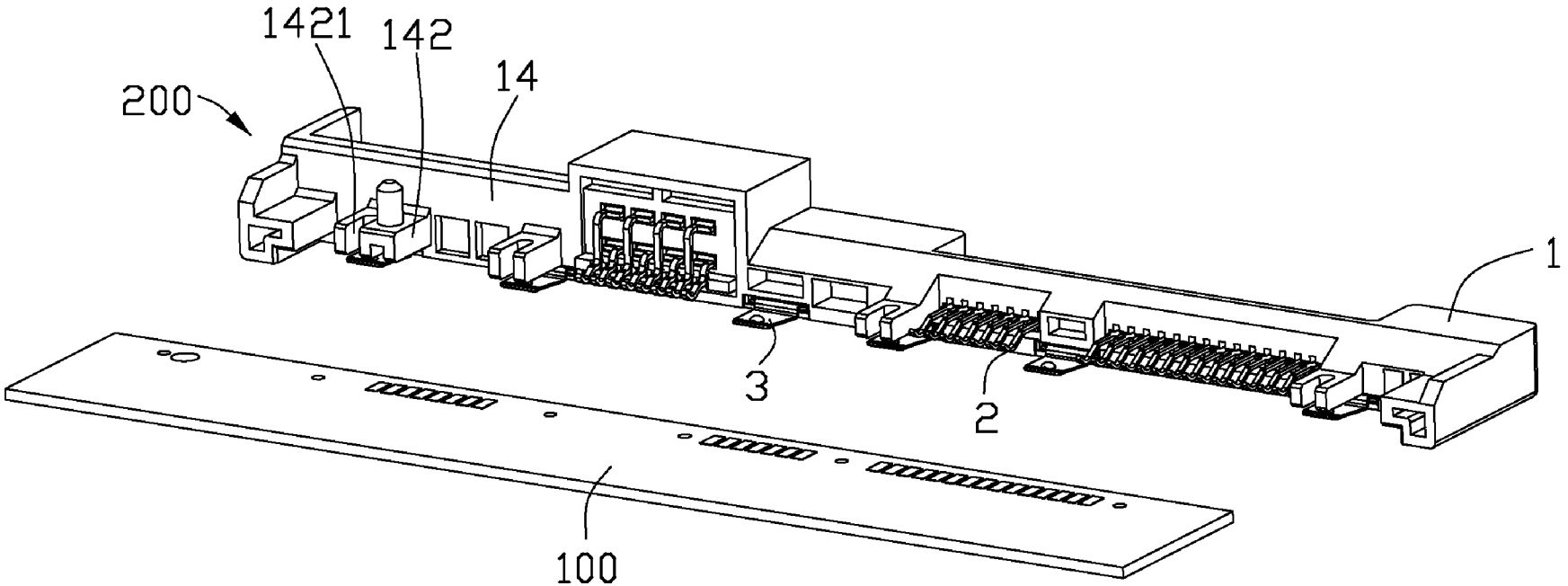
FIG. 3 is a top and rear perspective view of the electrical connector of FIG. 1 and the PCB.
Figure 4:
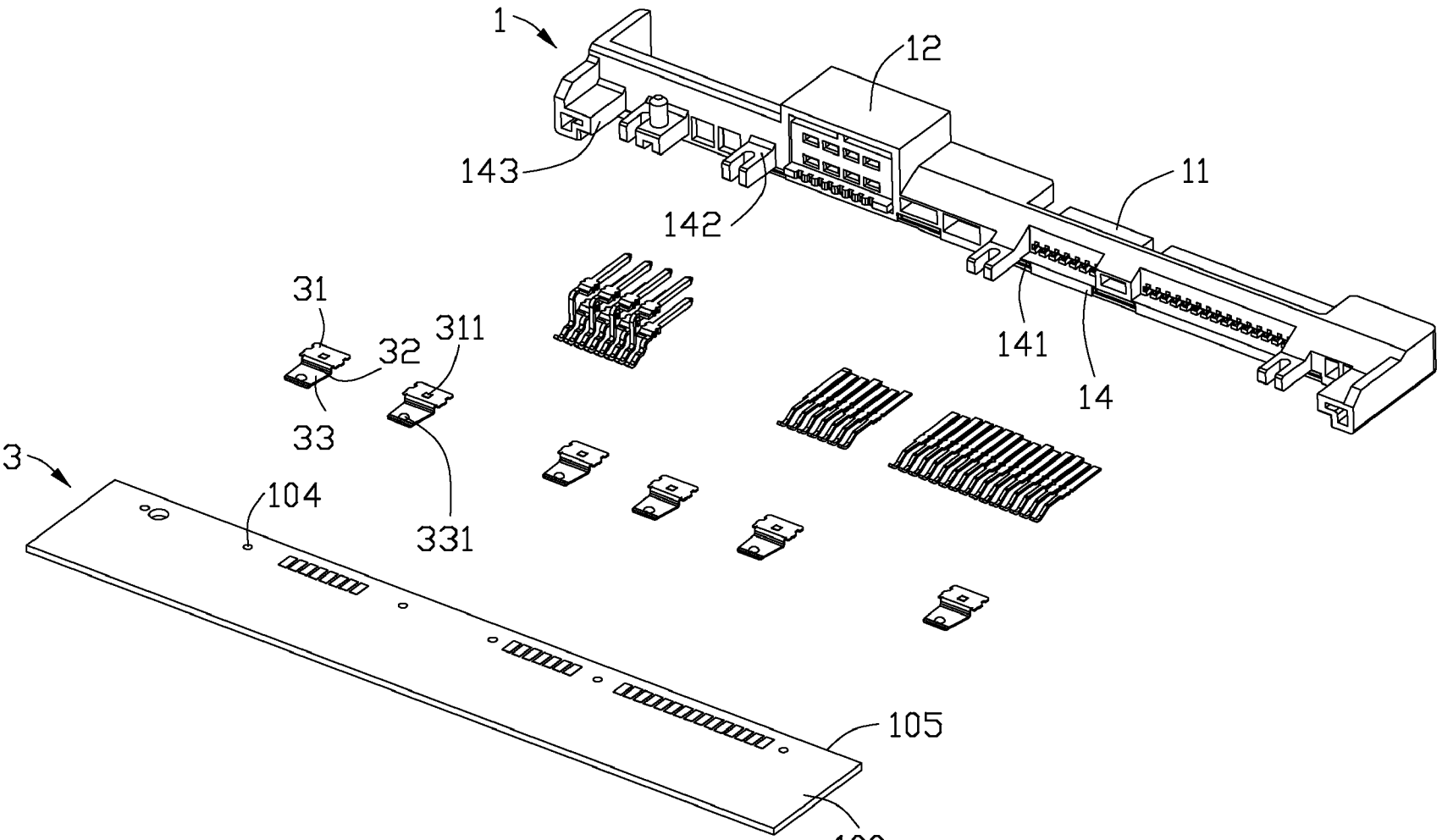
FIG. 4 is a top and rear, exploded view of the electrical connector of FIG. 1 and the PCB.
Figure 5:
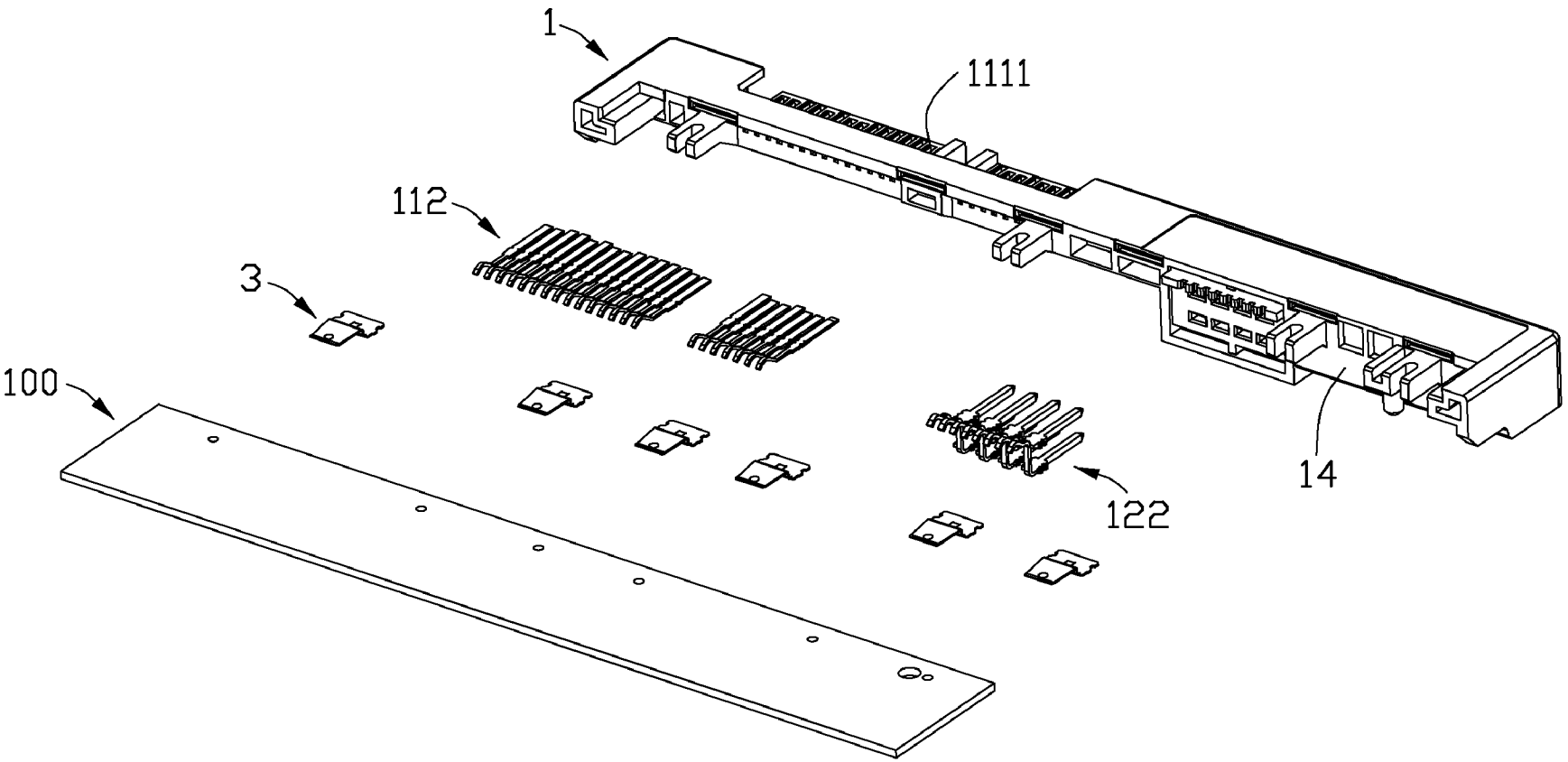
FIG. 5 is a bottom and rear, exploded view of the electrical connector of FIG. 1 and the PCB.
Figure 6:
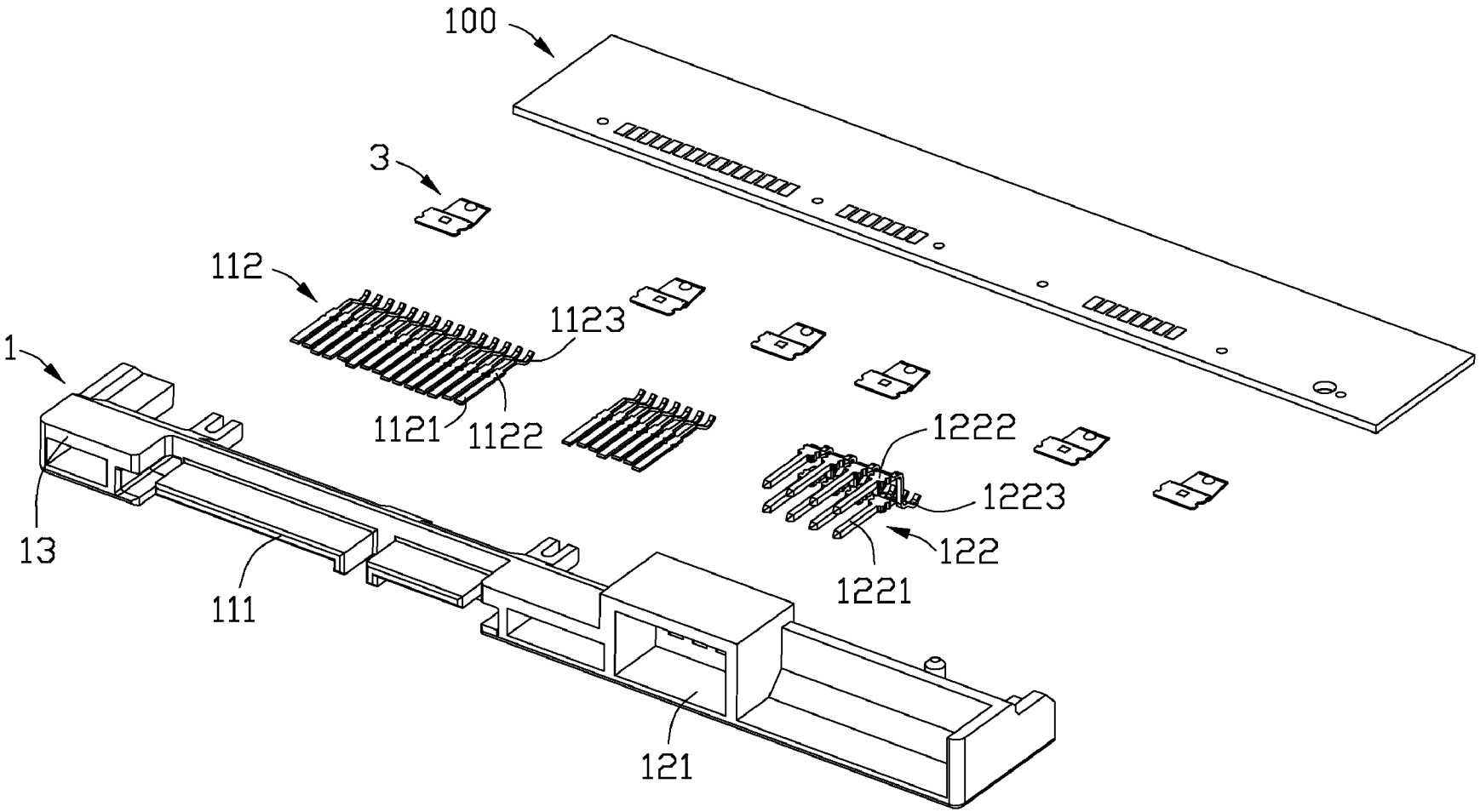
FIG. 6 is a top and front, exploded view of the electrical connector of FIG. 1 and the PCB.
Figure 7:
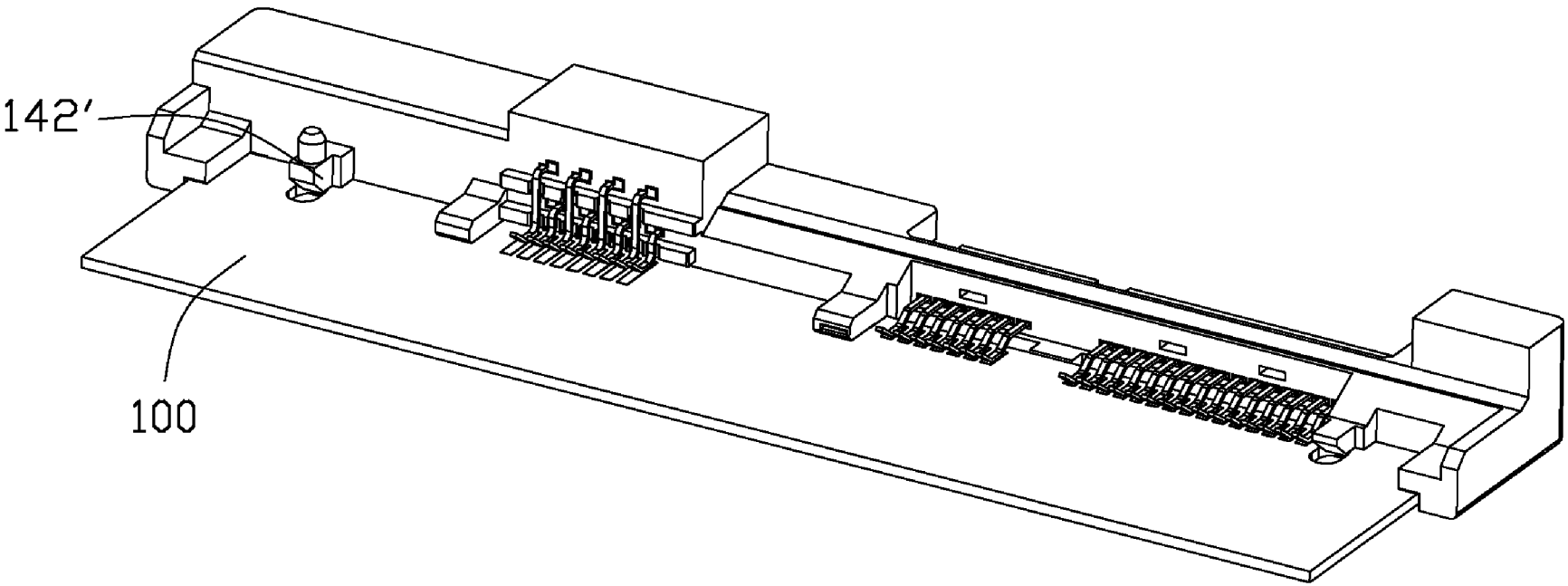
FIG. 7 is a top and rear perspective view of an electrical connector in accordance with a second embodiment of the present invention secured to a PCB.
Figure 8:
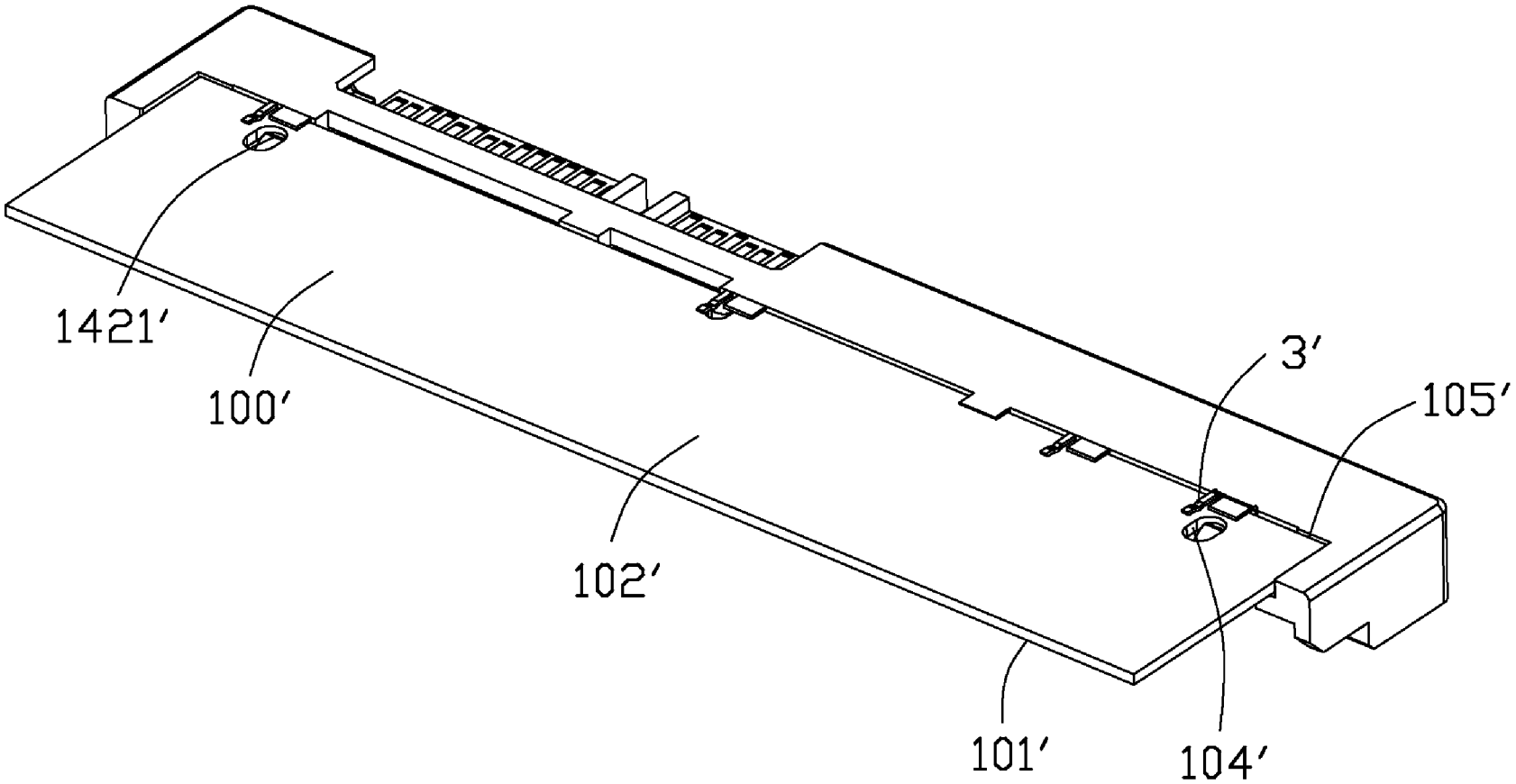
FIG. 8 is a bottom and rear perspective view of the electrical connector of FIG. 7 secured to the PCB.
Figure 9:
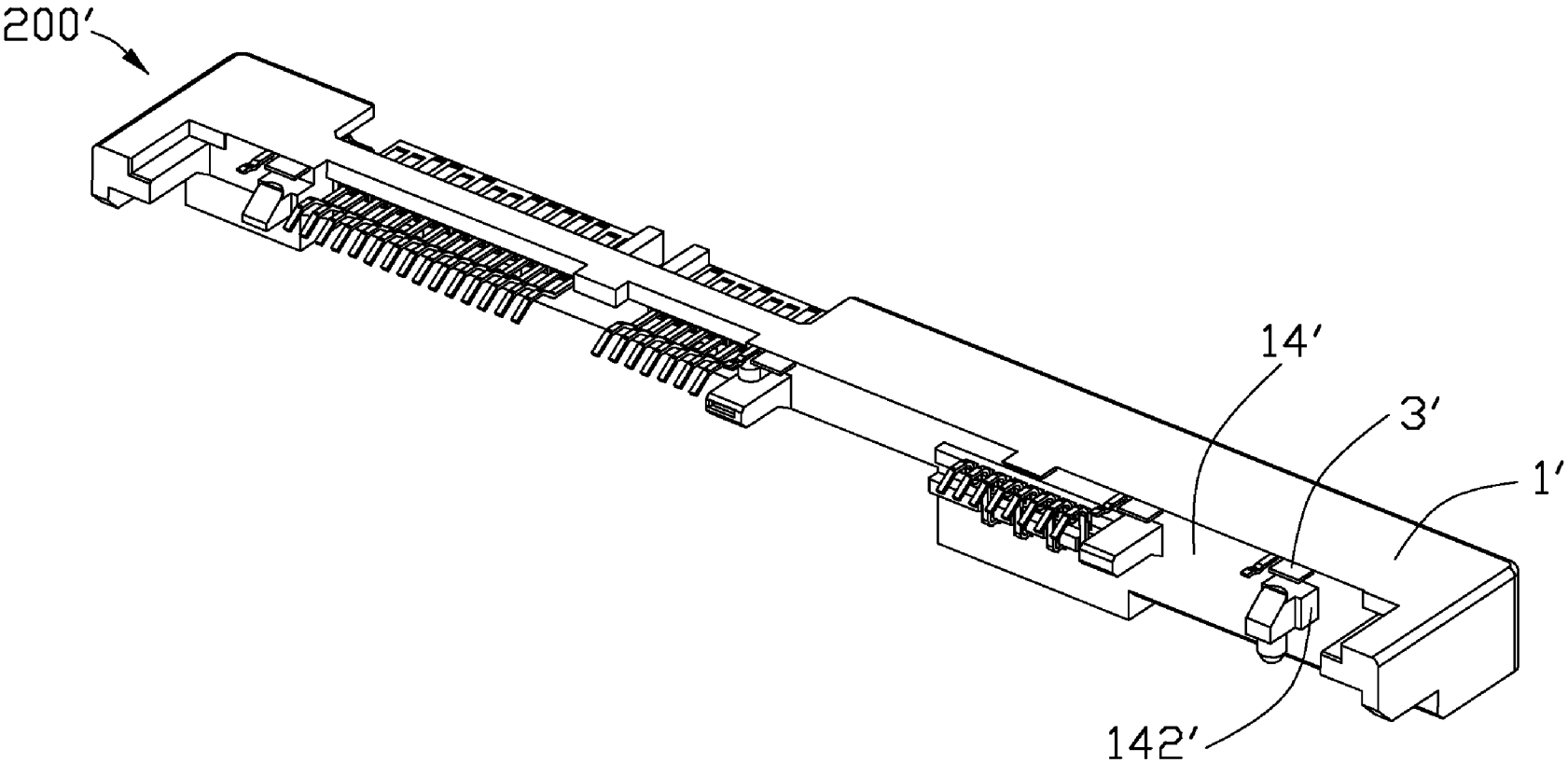
FIG. 9 is a bottom and rear perspective view of the electrical connector of FIG. 7.
Figure 10:
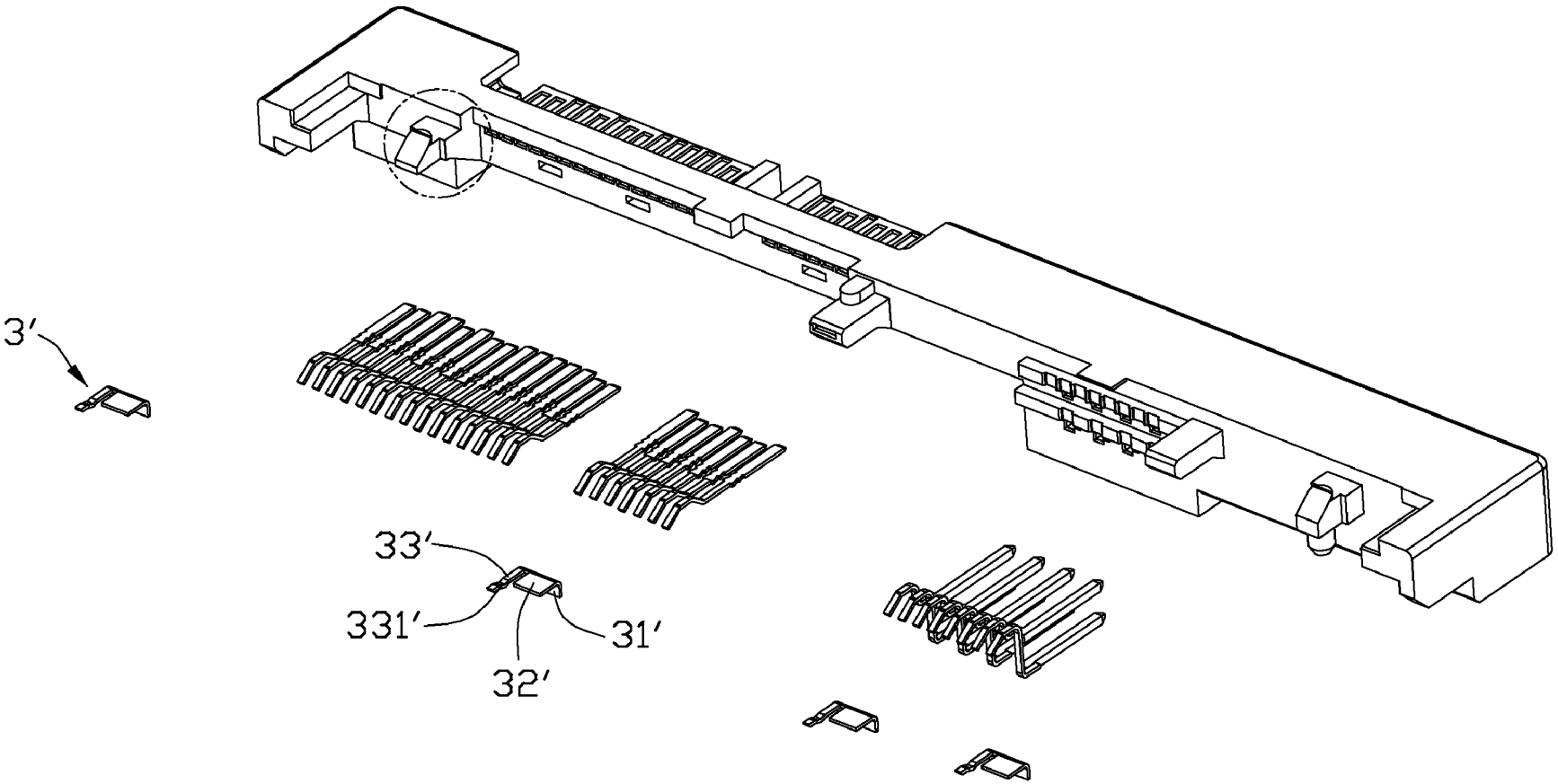
FIG. 10 is a bottom and rear, exploded view of the electrical connector of FIG. 7.
Figure 11:
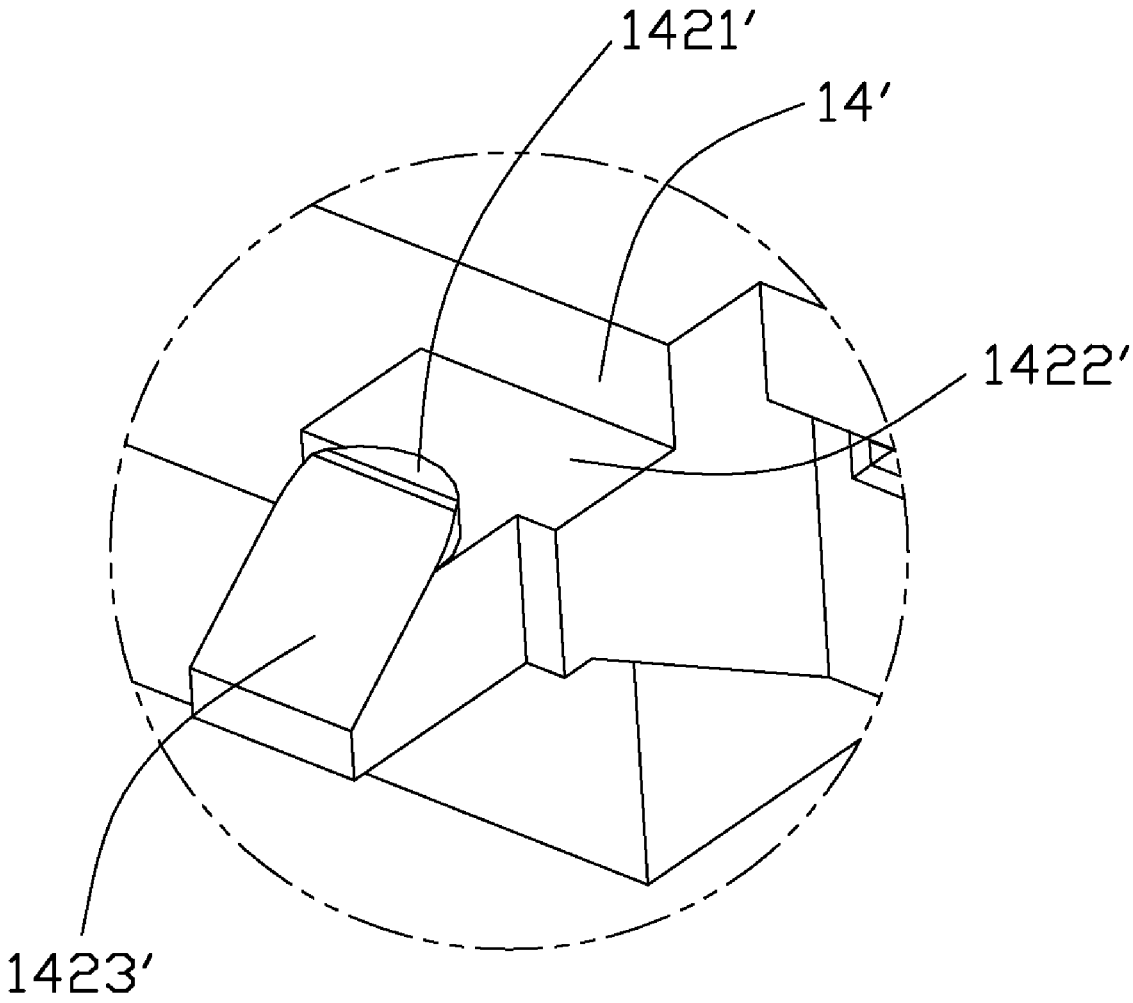
FIG. 11 is a large view of a rectangle block of the electrical connector of FIG. 7.

Referring to FIGS. 3-4, the electrical connector 200 includes an elongate insulative housing 1 and a plurality of contacts 2 assembled in the insulative housing 1. The insulative housing 1 includes a data section 11 and a power section 12 integrally arranged along a length thereof. Referring to FIGS. 5-6, the insulative housing 1 defines a front mating face 13 and a rear mounting face 14 opposite to the mating face 13. The data section 11 is a serial ATA plug connector. The data section 11 includes a pair of L-shaped tongues 111 and a plurality of data terminals 112 retained in a downward side of the pair of tongues 111. Each data terminal 112 defines a first contacting portion 1121 of a plate shaped connecting with a mating connector (not shown), a first soldering portion 1123 with elasticity abutting against the welding areas 103 of the PCB 100 and a first retaining portion 1122 bridging the first contacting portion 1121 and the first soldering portion 1123. The first retaining portion 1122 is secured to the insulative housing 1 by a plurality of barbs on two sides thereof. The tongues 111 define a plurality of terminal receiving passageways 1111 receiving the data terminals 112 and the first contacting portions 1121 are shown up from the terminal receiving passageways 1111. The power section 12 is a power plug connector. The power section 12 includes a receiving cavity 121 of a frame shaped extending backward from the mating face 13 and a plurality of power terminals 122 received in the receiving cavity 121. Each power terminal 122 defines a second contacting portion 1221 of a columniation shaped extending frontwards from a backward wall of the receiving cavity 121, a second soldering portion 1223 with elasticity abutting against the welding areas 103 of the PCB 100 and a second retaining portion 1222 bridging the second contacting portion 1221 and the second soldering portion 1223. The second retaining portion 1222 protrudes from the backward wall of the receiving cavity 121 and abuts against the welding areas 103 of the PCB 100. The power terminals 122 arrange in two rows and the second soldering portions 1123 are in the same plane with the first soldering portions 1123. The data terminals 112 and the power terminals 122 are inserted into the insulative housing 1 from the mounting face 14.

The electrical connector 200 further includes a plurality of board-lock pieces 3 stamping from metal sheet. Referring to FIG. 4, each board-lock piece 3 defines a fixing portion 31 received in the insulative housing 1, a terminal portion 33 and a connecting portion 32 perpendicularly connecting the fixing portion 31 and the terminal portion 33. The insulative housing 1 further defines a plurality of receiving grooves 141 extending frontwards from the mounting face 14 to receive the fixing portions 31. Each terminal portion 33 defines a first tuber 331 protruding from an upward face thereof and received in the through hole 104 of the PCB 100. The first tuber 331 is configured with round-point. Each fixing portion 31 is retained in the receiving groove 141 by a second tuber 311 protruding from an upward face of the fixing portion 31 to secure the board-lock piece 3 to the insulative housing 1 steadily. A first face of the connecting portion 32 abuts against a side face 105 of the PCB 100 which connects the upward face 101 and the downward face 102 and a second face opposite to the first face abuts against the mounting face 14 of the insulative housing 1. Two ends of the groups of the contacts 2 are arranged with a pair of the board-lock pieces 3 to prevent the contacts 2 from releasing from the PCB 100.

Referring to FIG. 3, the insulative housing 1 further defines a plurality of rectangle blocks 142 extending backward from the mounting face 14. The rectangle blocks 142 are located above the corresponding board-lock pieces 3 so that each block 142 is aligned with one board-lock piece 3 with a space. The PCB 100 is set in the space to clip by the blocks 142 and the board-lock pieces 3. A pair of flanges 143 forms on two length distal ends of the insulative housing 1 and is configured with a reversal L-shaped manner. The rectangle blocks 142 are resisting on the upward face 101 of the PCB 100 and the flanges 143 are resisting on two length distal ends of the PCB 100 to further secure the PCB 100 and the electrical connector 200. The blocks 142 are arranged generally at ends of groups of the contacts 2 to ensure a good retention. The blocks 142 can designed with a slot 1421 in a vertical direction to enlarge the elasticity thereof since the blocks 142 integrally formed form the insulative housing 1 with little elasticity. The board-locking piece 3 is elastically pressed against the downward face 102 of the PCB 100 to avoid short circuit with the welding areas 103.

Referring to FIGS. 7-10 showing the second embodiment of the present invention wherein the connector is similar to the connector of the first embodiment except the rectangle blocks 142' and the board-lock pieces 3'. the rectangle blocks 142' are at two sides of the insulative housing 1'. Each rectangle block 142' defines a supporting face 1422' abutting against the PCB 100' and a slant face 1423' extending backward from the supporting face 1422'. A plurality of projections 1421' are formed at points of the supporting faces 1422' and the slant faces 1423'. The projections 1421' are inserted into the through holes 104'. The board-lock piece 3' is configured with an L-shaped manner and insert-molding in the insulative housing 1. Each board-lock piece 3' defines a fixing portion 31', a terminal portion 32' perpendicular to the fixing portion 31' and an elastic portion 33' extending from the fixing portion 31'. The terminal portion 32' abuts against the upward face 101' of the PCB 100'. The elastic portion 33' is parallel to the terminal portion 32' and defines an arc portion 331' abutting against the PCB 100. The PCB 100' is fixed to the space between the blocks 142' and the board-lock pieces 3' guiding by the slant face 1423'. The upward face 101' abuts against the supporting face 1422' and the downward face 102' abuts against the terminal portion 32' and the side face 105' abuts against the mounting face 14' of the insulative housing 1'. The projections 1421' are received in the through holes 104' and the arc portions 331' abuts against the PCB 100' to further secure the PCB 100' and the electrical connector 200'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector secured to a printed circuit board (PCB) having a plurality of welding areas on an upward face thereof and a plurality of through holes running through the PCB, comprising:

an elongate insulative housing defining a mating face and a mounting face opposite to the mating face, a plurality of blocks protruding from the mounting face;

a plurality of contacts assembled to the insulative housing and each contact defining a contacting portion connecting with a mating connector, a retaining portion retained in the insulative housing and a soldering portion welding to the welding areas of the PCB; wherein a plurality of board-lock pieces made of metal material under the corresponding blocks to clip the PCB between the blocks and the board-lock pieces, a projection from one of the board-lock piece and the block inserted into one of through holes; wherein each board-lock piece defines a fixing portion received in the insulative housing, a terminal portion abutting against the PCB and a connecting portion perpendicularly connecting the fixing portion and the terminal portion, a first face of the connecting portion abutting against a side face of the PCB which perpendicular to the upward face and a second face of the connecting portion opposite to the first face abutting against the mounting face opposite to the upward face; wherein each terminal portion defining a first tuber protruding from an upward face thereof and received in the through hole of the PCB, the first tuber is configured with round-point; wherein each fixing portion is fixed in the insulative housing by a second tuber of a round-point shaped protruding from the fixing portion.

2. The electrical connector as claimed in claim 1, wherein the blocks are pressed against the upward face of the PCB and the block-locking pieces are against a downward face opposite to the upward face.

3. The electrical connector as claimed in claim 2, wherein each block defines a supporting face abutting against the downward face of the PCB and a slant face extending from the supporting face, the projection located at a point of the supporting face and the slant face.

* * * * *